United States Patent [19]

Pearce

[11] 4,332,067

[45] Jun. 1, 1982

[54] PAINT ROLLERS

[76] Inventor: John W. Pearce, 413 Broadway SE., Warren, Ohio 44483

[21] Appl. No.: 101,230

[22] Filed: Dec. 7, 1979

[51] Int. Cl.[3] ..... B05C 17/02

[52] U.S. Cl. ..... 29/116 R; 15/230.11; 29/126

[58] Field of Search ..... 15/230.11; 134/138, 134/139, 149; 29/116 R, 110.5, 120, 126; 68/213

[56] References Cited

U.S. PATENT DOCUMENTS

| | | | |
|---|---|---|---|
| 2,542,491 | 2/1951 | Engel | 15/230.11 X |
| 2,741,013 | 4/1956 | Messmer | 29/116 R |
| 2,913,752 | 11/1959 | Boyles | 68/213 X |
| 2,982,010 | 5/1961 | Johns | 29/116 R |

*Primary Examiner*—Edward L. Roberts
*Attorney, Agent, or Firm*—Michael Williams

[57] ABSTRACT

The invention comprises a cage structure for a paint roller to support the cover for rotation about a shaft having a handle connected to an angularly displaced portion of the shaft, for the usual painting function, and a substantially similar cage structure fixed against rotation on a rectilinear shaft, the similar cage structure being adapted to support a roller cover that needs to be cleaned of paint, an end of the rectilinear shaft being adapted to be grasped by the chuck of an electric drill for rapid rotation, whereby the paint on the cover is removed therefrom by centrifugal action. It is the intent of this invention to simplify the manufacture of roller cages by duplication of parts in the painting function and the cleaning function to thereby drastically reduce their cost.

4 Claims, 10 Drawing Figures

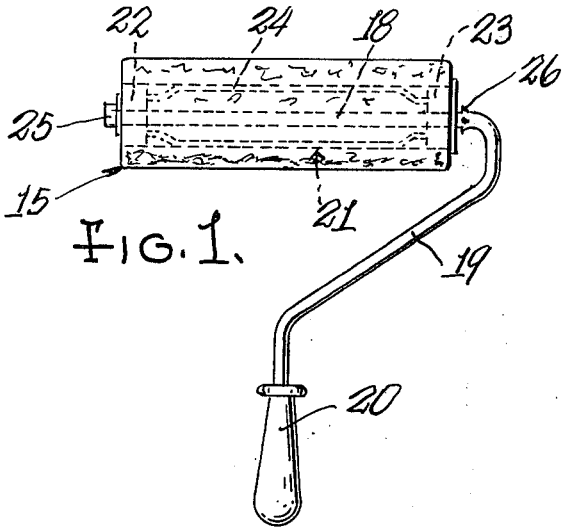
FIG. 1.
FIG. 2.
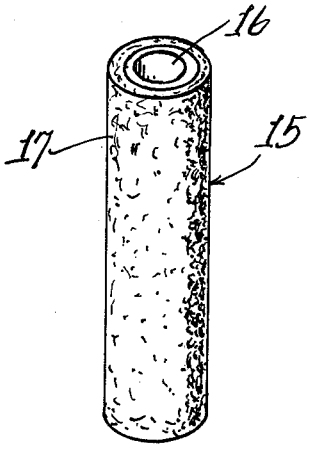
FIG. 3.
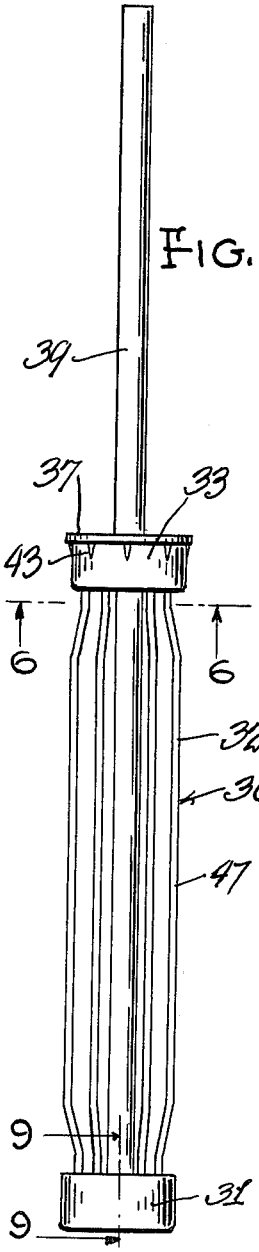
FIG. 4.
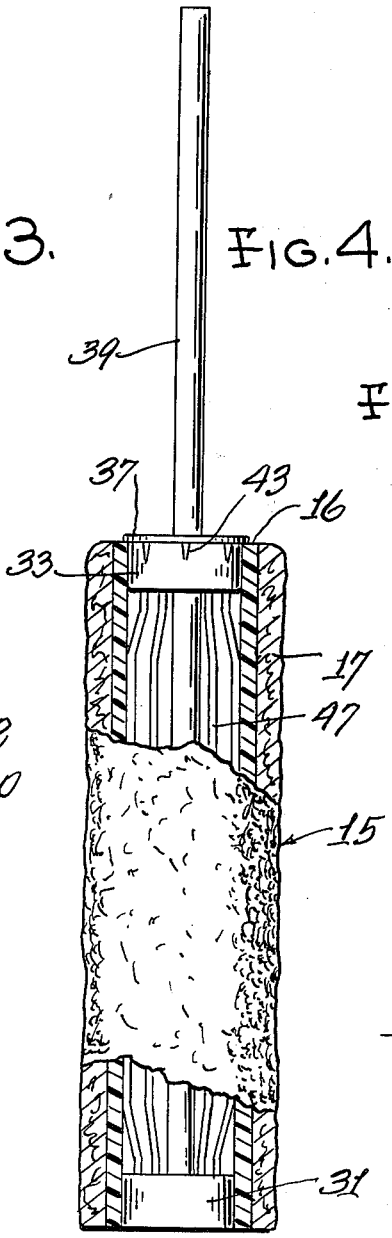
FIG. 10.
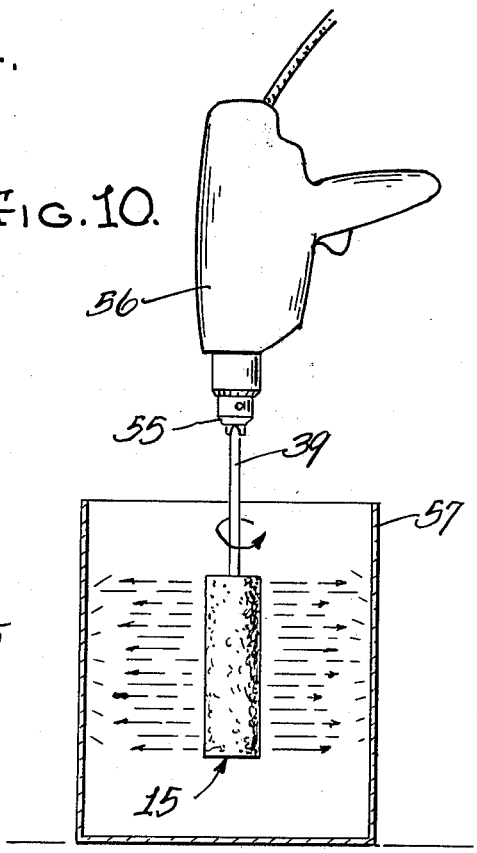

PAINT ROLLERS

BACKGROUND AND SUMMARY

The prior art contains devices for supporting the cover of a paint roller and for rapidly rotating the cover to remove paint therefrom by centrifugal action, but these have had no commercial success, insofar as applicant is aware. Applicant has been in the business of selling paint and painting accessories such as paint rollers, paint brushes and the like, for about 35 years, and in that time has not seen a paint roller cleaner that will operate efficiently and yet be of a cost low enough to warrant wide-scale purchase thereof.

My invention makes it possible to drastically reduce the cost of paint-removing devices of this kind by the duplication of parts to simply manufacture and assembly, to produce substantially identical cages, one to support the roller cover for normal painting operations, and the other to support the same roller cover for rapid rotation to remove paint therefrom by centrifugal action.

DESCRIPTION OF THE DRAWINGS

In the drawings accompanying this specification and forming a part of this application, there is shown, for purpose of illustration, an embodiment which my invention may assume, and in these drawings:

FIG. 1 is a small-scale elevational view showing a usual paint roller,

FIG. 2 is a perspective view showing the cover of the roller removed from its supporting structure, FIG. 3 is a side-elevational view of a cage structure for supporting a roller cover, the view being drawn to a slightly larger scale, FIG. 4 is a view similar to FIG. 3, but with the roller cover around the cage, the cover being partially shown in section, FIG. 10 shows the roller and cage structure of FIG. 4 with the upper end of the shaft held within the chuck of an electric drill, the roller cover being rapidly spun within a container to remove paint from the cover by centrifugal action.

DESCRIPTION OF THE PREFERRED EMBODIMENT

Figure 5:
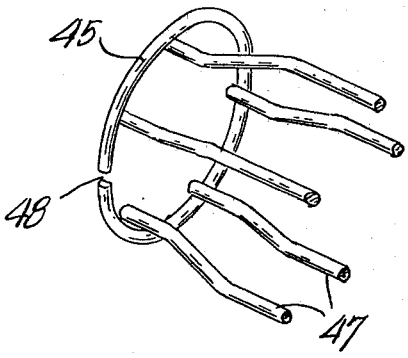
FIG. 5 is a fragmentary perspective view of one end of the wire portion of the cage structure, the opposite end being identical.

Most paint roller covers 15 on the market comprise a cylindrical core 16 having a fuzzy or textured exterior 17 cemented thereto. The core is made of a rigid plastic of substantial thickness to withstand repeated handling. The exterior 17 may be made of synthetic or real wool, or any other suitable substance.

The roller cover is shown in FIG. 1 as supported on a shaft 18 for rotation thereabout in normal manner. The shaft has an angularly-extending portion 19 terminating in a handle 20. The roller cover is slipped over a cage 21 comprising spaced heads 23,23 which are connected by a wire portion 24. An acorn nut 25 is clamped on the free end of the shaft 18 and the shaft has displaced portions 26 to hold the cage 21 and the roller cover carried thereby, in rotatable position on the shaft. All of the foregoing is of usual construction.

After the paint roller has been used and the painting job is completed, it is desirable to clean the paint roller and this could be a messy and fruitless job unless the paint is removed as herein disclosed. The cover is removed from the cage 21 by relatively moving the two in an axial direction, so that the roller cover is slipped off of the cage 21.

The cover 15 is then slipped over the cage 30 shown in FIG. 3 to a position shown in FIG. 4. This is accomplished by moving the cover endwise (either end) over a first head 31, over the wire portion 32 and onto a second head 33. An important aspect of this invention is that the heads 22 and 31 are identical, as are the heads 23 and 33, and as are the wire portions 24 and 32. This not only facilitates production of the roller cover cages, but also insures that one after the other will have the very same physical dimensions for uniformity. Also, the cost of the cages will be materially reduced since only two molds will be required to produce the heads and only one jig will be required to hold the wires of the wire portions in position for interconnection. Further economy will be effected since the roller cover cages may be mass produced and used for either painting or cleaning operations, as required.

Figure 6:
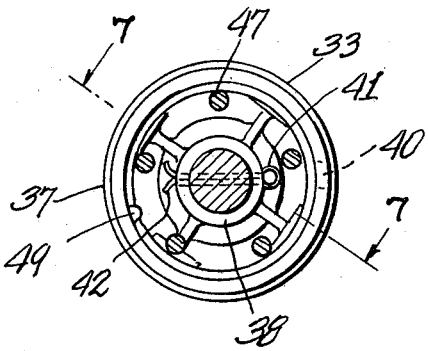
FIG. 6 is a sectional view corresponding to the line 6—6 of FIG. 3 and drawn to a larger scale.
Figure 7:
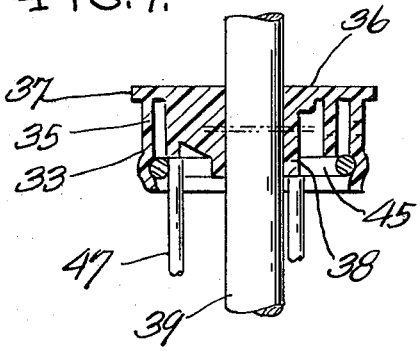
FIG. 7 is a sectional view corresponding to line 7—7 of FIG. 6.
Figure 8:
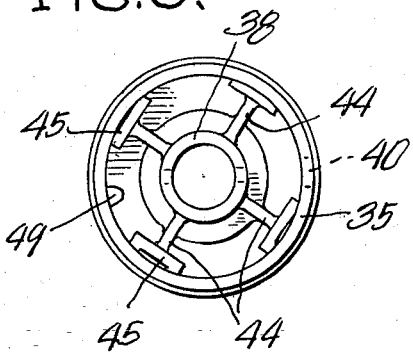
FIG. 8 is an elevational view illustrating the head shown in FIG. 6 with the wire portion removed.

The head 33 is shown in detail in FIGS. 6, 7 and 8 and, as indicated, is formed of a suitable plastic material, such as polypropylene or the like. The head is generally cup-shaped with an annular skirt wall 35 and a bottom wall 36 closing one end of the skirt wall. The bottom wall has an annular shoulder 37 to form a stop for the roller cover 15 in either the painting or cleaning situations.

The head has a central hub 38 for receiving a shaft 39, and the head in this case is fixed to the shaft so as to be rotatable therewith. In the presently-disclosed embodiment, the skirt wall 35 is formed with an opening 40 large enough to pass the eye 41 of a cotter pin so that the latter may be completely moved through the opening 40 and have its legs 42 inserted through aligned holes in the central hub 38 and shaft 39 to thereby lock the head to the shaft. The head 31 need not be locked to the shaft since it is rigidly connected to the head 33 by the wire portion 32. As best seen in FIG. 3, the skirt 35 has a series of ribs 43 projecting from the annular shoulder 37 to provide a gripping action with the interior of the roller cover core 16 and thus insure that the cover will rotate with either cage 21 or 30. As best seen in FIG. 8, four ribs 44 radiate from the hub 38 and terminate in ledges 45 which are disposed a predetermined distance inwardly from the open end of the skirt wall 35.

The wire portion of either cage 21 or 30 comprises similar rings 45,46 at opposite ends, the rings being joined by a plurality of spanning wires 47 (five in the disclosed embodiment). As seen in FIGS. 3 and 5, each wire 47 has an end brazed to the inner surface of a respective ring, the wires intermediate the heads 31 and 33 bulging outwardly to closely fit within the core 16 of the roller cover. Each ring 45,46 has a split portion 48 for a purpose to be disclosed.

Figure 9:
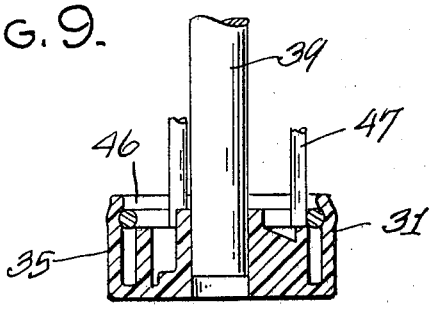
FIG. 9 is a sectional view corresponding to the line 9—9 of FIG. 3 and drawn to a larger scale.

Each ring is forced into the opening in a respective plastic head 31,33 to slightly distend the skirt wall 35 as seen in FIGS. 7 and 9 to establish a frictional fit between ring and head. The ledges 45 limit the inward movement of each ring, and a rib 49 projecting from the inner surface of the skirt wall extends into the split portion 48 to insure that the wire cage rotates with the respective heads.

As noted above, the heads 22 and 31, and the heads 23 and 33, are identical, to facilitate production. The heads 31 and 33 are almost identical and therefore this would be true of the heads 22 and 23. If enough friction is generated by a close fit between the roller cover core 16 and the heads 23 or 33 and the spanning wires of a respective cage, the ribs 43 on the head 23 or 33 may be omitted, making the heads to differ only in the annular stop 37 since all may be formed with the opening 40 in the skirt wall 35, even though the opening has no purpose in the paint rolling condition of FIG. 1, or in the head 31 shown in FIGS. 3 and 4.

When it is desired to clean the roller cover of paint, the cover is removed from the roller shown in FIG. 1 and assembled with the heads and cage as seen in FIG. 4. The end of the shaft 39 is engaged in the chuck 55 of an electric drill 56 (see FIG. 10). The roller cover thus supported is dipped into a paint solvent and the roller disposed within a container 57 and the motor energized to rapidly spin the roller cover and remove the paint therefrom, the cover after this operation having a like-new appearance.

I claim:

1. For use with a paint roller having a cylindrical inner tube of rigid material and an exterior paint-absorbent cover about the exterior of said tube and fixed thereto, the improvement comprising a skeleton frame adapted to fit within said tube, including, a rectilinear shaft, a pair of cylindrical heads on said shaft, one head at one end of said shaft and another spaced inwardly of said shaft end an amount substantially equal to the length of said inner tube, at least one head having a pinned connection with said shaft for rotation therewith, each head having an outside diameter of a size to closely and frictionally fit within said inner tube, said heads being formed of plastic material, such as polypropylene and the like, each of said heads being cup-shaped and said heads being disposed in facing relation, the cup shape of a head providing a skirt wall, a plurality of rigid wires extending between said heads and a circular wire at each end of said plurality of wires and rigidly connected thereto to hold said wires in peripherally-spaced relation to form a wire cage, each circular wire being of a slightly larger diameter than the inside diameter of a respective skirt wall to frictionally fit within such wall, said wire cage maintaining said heads in spaced relation and connecting said heads so that both rotate with said shaft, said shaft being adapted to be clamped in the chuck of an electric motor so that the skeleton frame and the paint roller may be rapidly rotated to expel paint from said cover by centrifugal action.

2. The construction according to claim 1 wherein each head has a central hub to receive a portion of said shaft, at least one of said hubs having a diametrical opening aligned with a diametrical opening in said shaft, and a pin extending through the aligned openings to provide said pinned connection.

3. The construction according to claim 2 wherein the skirt wall of a head has an opening large enough to pass the eye of a cotter pin so that the legs of the latter may be moved through the diametrical opening of said one hub with the cotter pin eye bearing against said hub at one side and the extremity of the legs of the cotter pin spread over the other side of the hub to maintain the assembly.

4. The construction according to claim 1 wherein at least one of said circular wires has its ends unattached to each other to form a gap, and wherein the skirt wall of at least one head has an inward projection adapted to fit within said gap to further effect connection between said wire cage and said one head to hold the two together for unitary rotation.

* * * * *